United States Patent [19]

Ebisch

[11] 4,125,135

[45] Nov. 14, 1978

[54] DEVICE FOR EXERTING BACK-PULL ON THE HEDDLES OF JACQUARD LOOMS

[76] Inventor: Wolfgang Ebisch, In den Eichen, 5249 Breitscheidt-Heide, Fed. Rep. of Germany

[21] Appl. No.: 814,935

[22] Filed: Jul. 12, 1977

[30] Foreign Application Priority Data

Jul. 10, 1976 [DE] Fed. Rep. of Germany ..... 2631175

[51] Int. Cl.[2] ..... D03C 13/00; D03C 3/22; D03C 3/44

[52] U.S. Cl. ..... 139/456; 139/59; 139/85; 139/90

[58] Field of Search ..... 139/456, 55.1, 59, 317, 139/85, 90, 455

[56] References Cited

U.S. PATENT DOCUMENTS

| | | | |
|---|---|---|---|
| 572,246 | 12/1896 | Cuscaden et al. | 139/456 |
| 972,349 | 10/1910 | Drury | 139/456 |
| 2,558,284 | 6/1951 | Whitaker | 139/456 |
| 3,853,150 | 12/1974 | Romano | 139/456 |

FOREIGN PATENT DOCUMENTS

| | | | |
|---|---|---|---|
| 405,980 | 3/1974 | U.S.S.R. | 139/456 |

*Primary Examiner*—James Kee Chi

[57] ABSTRACT

This relates to a device for exerting a back-pull on the heddles of Jacquard looms. In such looms the upper end of each heddle is connected to a patterning machine and it is necessary that the lower end of the heddle be connected to a pulling device which applies the necessary pull in the opposite direction to return the displaced heddle. Each heddle has permanently connected thereto a piston which is positioned within a cylinder guide with one end of the cylinder guide being open into a chamber wherein a pressure other than atmospheric pressure is maintained and the opposite end of the cylinder guide is open to the atmosphere in a manner wherein each piston and its associated heddle is displaced away from the patterning machine. The pull-back pressure may be varied by varying the pressure within the chamber.

12 Claims, 8 Drawing Figures

DEVICE FOR EXERTING BACK-PULL ON THE HEDDLES OF JACQUARD LOOMS

This invention relates to a device for exerting back-pull on the heddles of Jacquard looms. In the production of woven patterns, Jacquard looms lift or lower certain warp threads so that either a top shed or a bottom shed is formed through which the weft thread is shot. In order to enable the warp thread to be pulled upwardly or downwardly from its median position so as to form the shed, the warp thread runs through a thread ring on a vertically disposed heddle. The upper end of the heddle is connected to a patterning machine, whereas its lower end is engaged by a pulling device which applies the necessary pull on the heddle in the direction opposite to that applied by the patterning machine.

In its simplest form, the pulling device may be a weight suspended from the heddle. The speed of the return movement of the heddle depends, in this case, upon the speed at which the weight drops. Since modern looms operate at rather high speeds, the speed at which the weight drops is no longer sufficient for pulling back the warp thread at the required speed. In order to increase the pull-back speed, weights have been replaced by helical springs which exert a resilient return force on the warp threads. However, helical springs of the necessary type have relatively large radial dimensions, and this has been found to be very disadvantageous in instances where a large number (several thousands) of heddles are arranged side-by-side.

It is also known to utilize rubberized springs as return elements to engage the heddles. Such springs are disclosed in German Pat. OS 1,962,826. Although these springs are of small three-dimensional size, they result in considerable lost work, since the return force, as in the case of helical springs, varies in dependence upon the distance traveled. Extension of the spring element is at its minimum in the bottom shed. In this position, the spring must apply certain tensile force to insure that a neat shed is formed. However, the return force does not need to be greater in any other shed position (middle or top shed). Nevertheless, because of the resilient properties of a spring, the return force becomes greater in the other shed positions. The effort required to overcome the increasing tensile forces during lifting of the shed represents nothing more or less than lost work. This lost work increases with the steepness of the spring characteristic curve. In practice it has been found that springs with particularly flat characteristic curves, i.e. springs involving little lost work, do not retain their initial length during long-term operation. In order to obtain the necessary tensile force in the bottom shed position, these springs have to be continuously adjusted. However, the adjustment can only be utilized if the space conditions in the loom permit, or until breakage due to excess stretching takes place. This is discussed in the article of Dr. Ing. Adolf Funder, Ing. (grad.) Hugo Griese; MELLIAND TEXTILBERICHTE 2/1974, p.105 et seq.

The primary object of this invention is to provide a back-pull device for heddles of a Jacquard loom that exerts a substantially constant return force irrespective of the shed position and at the same time permits a very rapid mode of operation.

In accordance with this invention, the object is achieved by way of a piston which is displaced in a substantially air-tight manner in a cylinder guide. The piston is fitted in the lower end of a respective heddle and the cylinder guide is carried by a wall of a chamber in which a pressure, different from atmospheric pressure, is maintained.

In accordance with the invention, each heddle is connected to its associated piston. The piston moves in the guide cylinder. All the guide cylinders extend into a common vacuum or high-pressure system so that the same pressure and, therefore, the same force is applied to all pistons. The guide cylinders do not necessarily have to be of circular cross section but may be of some other cross section, such as oval, to prevent rotation of the pistons which pistons are, of course, of the same cross section as the respective cylinders.

The chamber should be of such size that the pressure within the chamber does not alter substantially even when all the pistons are displaced in the same direction at the same time so that the same return force is continuously exerted on each piston irrespective of its position. No increase in force has to be overcome when lifting the shed, so that no loss of work occurs. The magnitude of the tensile force is determined by the size of the piston face and the differential between the pressure within the chamber and atmospheric pressure. The tensile force can thus be adapted to suit all practical requirements.

In the further advantageous form of the invention, the cylinder guides are open at the top and, at their lower ends, lead into the chamber in which a vacuum is maintained. A vacuum chamber of this kind can be achieved simply by connecting a suction pump to the chamber. Atmospheric pressure acts on one end of each of the pistons and the vacuum within the chamber acts on the opposite end.

In an alternative arrangement, the cylinder guides are open at their bottom ends and their upper ends lead into the chamber in which a pressure greater than atmospheric pressure is maintained. This system presupposes either a complicated arrangement for guiding the heddles or the passage of the heddles through the high pressure chamber. This pressure system does not necessarily have to be operated pneumatically. Instead it may be operated hydraulically and the hydraulic medium attends to force the pistons out of the chamber against the pulling action of the heddles. Any fluid that may leak out between the pistons and the cylinders can be trapped in a sump and pumped back into the chamber.

The cylinder guides are preferably arranged in the wall of the chamber with the same spacing as that of the holes in a harness board which determines the spacial distribution of the heddles. The bores in the cylinders can be arranged very closely side-by-side in the chamber wall so that the heddles extend precisely vertically from the chamber to the harness board. The chamber wall, like the pistons which slide, one in each of the cylinder guides, can be formed of a plastics material. If required, that zone in which the cylinder guides are arranged may also be larger than the perforated zone of the harness board. In such event, it is either necessary to deflect the heddles or to arrange a large number of cylinder guides in inclined positions.

Although a pneumatically operated device for lifting and lowering the warp thread in looms is known from German Pat. No. OS 2,248,656, in such device each thread ring is individually pneumatically controlled. The thread rings are secured to rigid piston rods which can move upwardly for forming the top shed, as well as downwardly for forming the bottom shed. In that apparatus, the known Jacquard machine is replaced by a pneumatic control means and the piston rods are likewise returned by means of helical springs.

With the above, and other objects in view that will hereinafter appear, the nature of the invention will be more clearly understood by reference to the following detailed description, the appended claims and the several view illustrated in the accompanying drawings.

IN THE DRAWINGS

Figure 1:
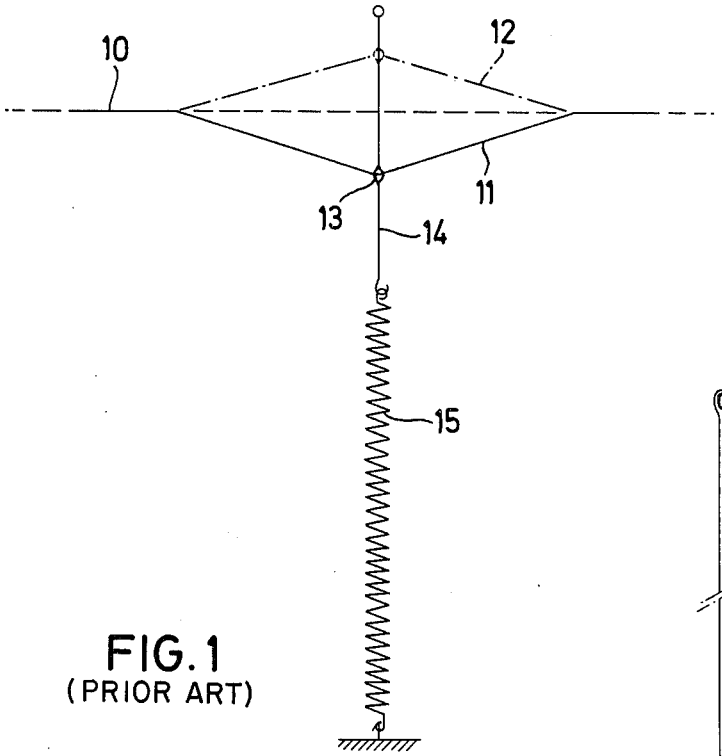
FIG. 1 (PRIOR ART)
FIG. 1 is a diagrammatic view illustrating the formation of the bottom shed and the top shed in the Jacquard machine and illustrating a return spring as the back-pull means.

Referring now to the drawings in detail, reference is first made to FIG. 1 wherein there is illustrated the movement of a warp thread 10 during the formation of the bottom shed 11 and the top shed 12. The warp thread is passed through a thread ring 13 which is formed in a metal wire and the position of which above the associated heddle 14 is controlled by the conventional patterning machine. In previous machines, a return weight was fitted at the lower end of the heddle whereas in more modern machines the return force is applied by a tension spring 15 which takes the form of either a helical spring, as illustrated, or a rubberized spring. It is to be understood that the arrangement shown in FIG. 1, particularly the return spring 15, is conventional.

Figure 2:
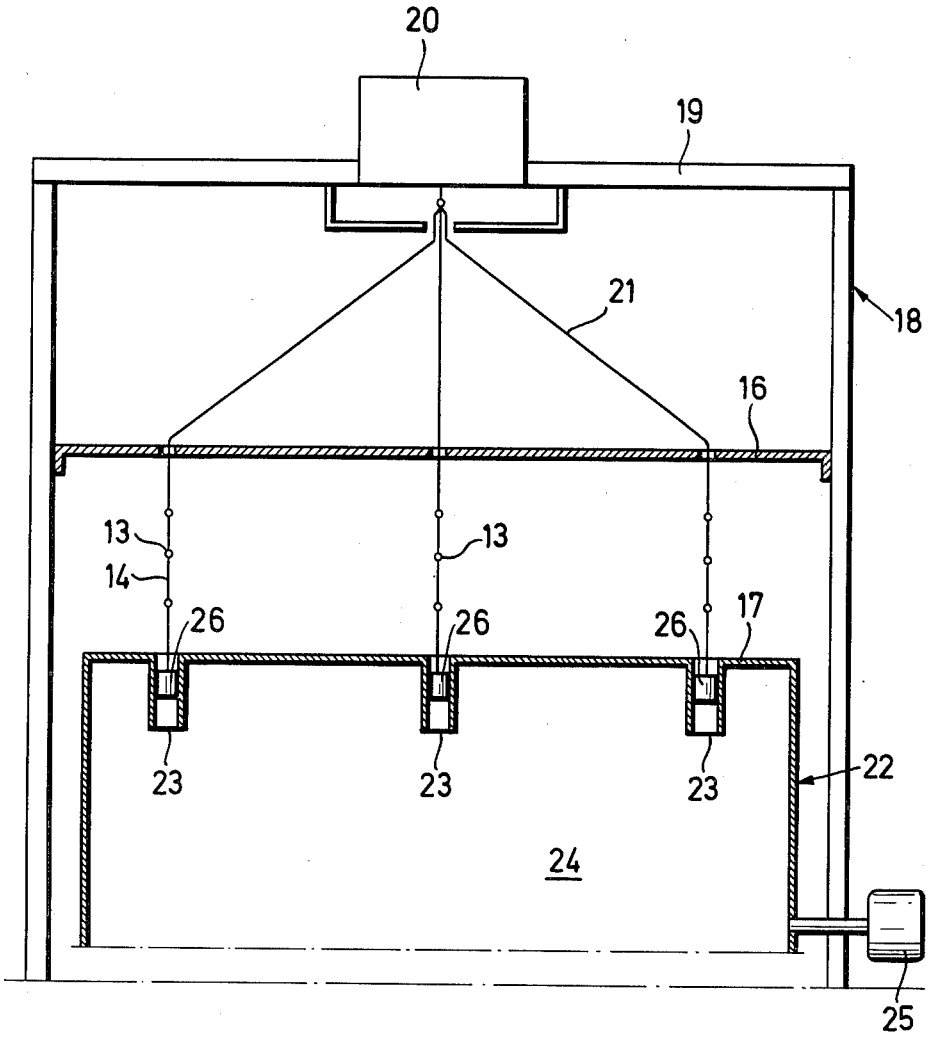
FIG. 2 is a schematic end view of a loom showing the arrangement of the heddles, the patterning machine, the harness cords and the harness board with a vacuum being utilized for exerting the return forces.

Referring now to FIG. 2 it will be seen that there is illustrated a machine frame 18 of a loom, other features of the loom being omitted for purposes of clarity. The machine frame 18 includes upper transverse beams 19 to which a patterning machine 20 is secured. Extending from the patterning machine 20 are harness cords 21 which are arranged in diverging relation and which individually control the level of thread rings 13 of each of the numerous warp threads. As a rule, several thousand harness cords 21 are present to control the level of a like number of warp threads.

The spacial distribution of the harness cords 21 emerging from the patterning machine 20 is effected by a harness board 16 which is carried by the frame 18 below the patterning machine 20. It is to be understood that the harness board has a plurality of rows of holes through each of which passes an individual harness cord 21. Although only three harness cords have been shown in the drawing, it is to be understood that a large number of further harness cords are present between those specifically illustrated. A fanned out distribution of the harness cords in the harness board 16 is necessary because it is impossible to arrange the harness cords side-by-side in a row in the same close proximity as that of the associated warp threads 10 when the latter are brought into the weave.

The patterning machine 20 pulls on the individual harness cords 21 and in this manner the individual thread rings 13 are actuated in a particular patterning program. The harness cords 21 are pulled back by a back-pull device 22 which is the subject of this invention. The device comprises a plate 17 which forms the wall of a chamber 24. The upper surface of the plate 17 has extending therefrom numerous cylinder guides 23 which project downwardly into the interior of the chamber. The cylinder guides are open at both ends with their lower ends opening into the chamber 24. A vacuum is maintained within the chamber 24 by means of a suction pump 25.

A piston 26 is mounted in each cylinder guide 23 for displacement relative thereto. It is to be understood that the relationship of each piston 26 with respect to its cylinder guide 23 is such that a substantially air-tight seal is obtained. Each piston 26 is connected to the lower end of a heddle 14 and is drawn into the chamber 24 by the vacuum produced in the chamber.

It is to be understood that the suction force applied on each piston 26 remains constant irrespective of the position of that piston in its cylinder guide. If the area of the piston face is, for example, 12 $mm^2$ (corresponding to a diameter of approximately 4 mm), the return force exerted on the piston is approximately 30 grams at 0.75 bar. The length of each cylinder guide is selected to correspond with the depth of the shed which is to be effected so that the pistons 26 do not move completely out of their cylinder guides during the operation of the loom.

The cylinder guides have a spacing equal to that of the holes in the harness board 16 so that the heddles 14 move rectilinear and vertical between the harness board 16 and the plate 17 and cannot be deflected.

Figure 3:
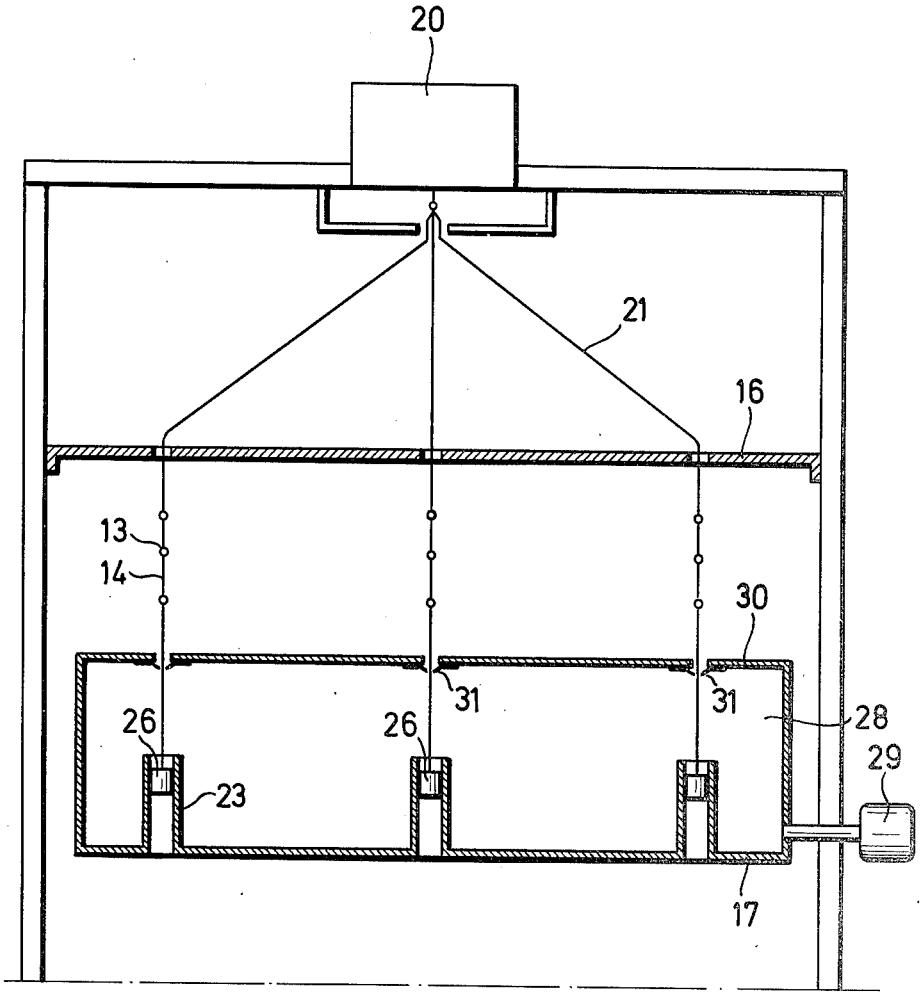
FIG. 3 is a schematic end view similar to FIG. 2 and shows the use of a super atmospheric pressure for exerting the return forces.

Reference is now made to FIG. 3 wherein in lieu of a vacuum chamber 25, a positive pressure chamber 28 is provided. The chamber 28 has the plate 17 forming the bottom wall thereof with the cylinder guides 23 again projecting into the interior of the chamber, but upwardly instead of downwardly as shown in FIG. 2. Pressure is maintained in the chamber 28 by means of a compressor type pump 29.

It is to be noted that the heddles 14 extend from the pistons 26 through the pressure chamber 28 from which they emerge through an upper wall 30 of the chamber. In order to maintain a seal of the chamber 28, suitable sealing elements 31 are carried by the wall 30 and sealingly engage respective ones of the heddles. It is to be understood that the pressure in the chamber 28 drives the pistons 26 downwardly and thus applies a constant tensile force on the heddles 14.

Figure 4:
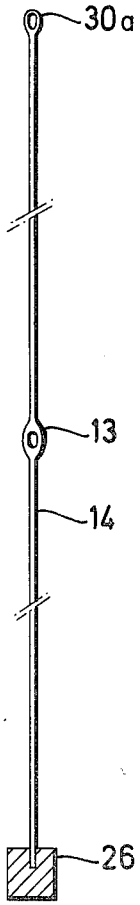
FIG. 4 is an elevational view with parts broken away of a heddle having a piston fixedly secured thereto, the piston being shown in section.

Reference is now made to FIG. 4 wherein a typical heddle construction is illustrated. It is to be noted that each heddle 14 is provided intermediate its ends with a thread ring, the lower end of the heddle is secured in a fixed manner to the associated piston 26. The heddle 14 is formed of a wire to the lower end of which is attached the piston 26 which is preferably formed of plastics material. The piston 26 is integrally connected with the wire by injection molding and, therefore, cannot be detached from the wire without being destroyed. At the upper end of the heddle 14 is a further ring 30*a* through which a harness cord 21 is secured to the heddle.

The device of this invention offers the advantage that only the absolutely necessary tensile force is applied over the entire displacement distance of the individual heddle. Since no lost work must occur, the patterning machines, which have to operate in a direction opposite that of the back-pulling devices, can be of correspondingly lighter construction, i.e., they can exert lower tensile forces than in a case where the known pulling devices, such as springs or weights, are used. Further, it will be readily apparent that the patterning machine is subjected to treatment that causes less damage.

A further advantage of the invention resides in the fact that the tensile force applied to each heddle is infinitely variable since the pressure differential on a piston 26 can be suitably varied by altering the pump capacity and thus varying the pressure within the associated chamber. None of the known back-pulling devices permit the use of such infinitely variable tensile force.

At this time it is pointed out that if more than one loom are present, their pulling devices can be connected to a common pressure or vacuum source. In this case, only a single pump and/or a single pressure chamber is required. The pressure chambers into which the cylinder guides directly lead can, therefore, be smaller, and this represents an advantage as regards assembly of the equipment.

Figure 5:
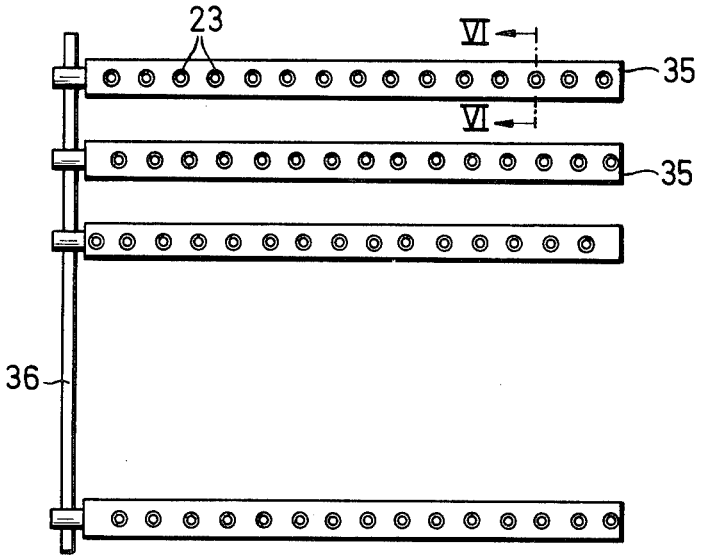
FIG. 5 is a plan view with parts omitted showing a modified arrangement of chambers and cylinder guides.
Figure 6:
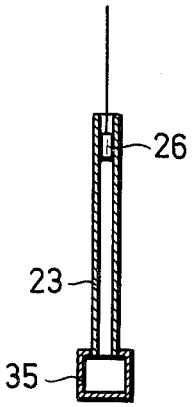
FIG. 6 is a fragmentary vertical sectional view taken along the line 6—6 of FIG. 5 and shows the specific construction of one of the cylinder guides in its associated chamber.

Reference is now made to FIGS. 5 and 6 wherein in lieu of the cylinder guides 23 being carried by a single large chamber, plural ducts 35 are provided and each duct carries at least one row of the cylinder guides 23. The ducts 35 are arranged parallel to each other and the cylinder guides carried thereby form a set of such cylinder guides. It is to be understood that the greater the number of ducts 35 or cylinder guides 23, the closer the thread spacing obtainable in the woven material. The position of each cylinder guide 23 corresponds to the position of a hole in the harness board 16. All of the ducts 35 are mechanically connected to a common transverse bar 36. It is to be understood that the connection of the ducts 35 to a vacuum source may be accomplished in a conventional manner by way of hoses. It is also to be understood that the ducts 35 may be supported at both ends thereof by like bars 36.

Figure 7:
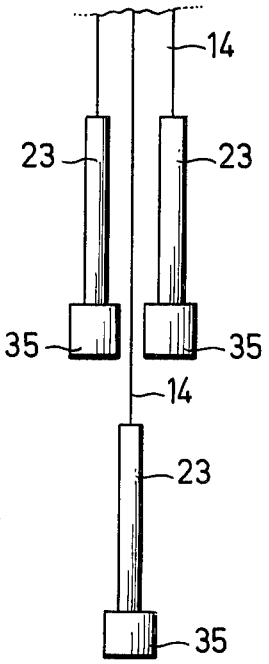
FIG. 7 is a schematic side elevational view showing the arrangement of distributing ducts and cylinders leading therefrom wherein the heddles are very closely spaced and wherein the ducts and cylinders are arranged in several different levels and in laterally offset relation.

It is to be understood that by utilizing the individual ducts 35, a very wide variety of thread spacings can be achieved without having to use a completely new set of cylinder guides carried by a single plate, such as the plate 17. If the spacing is to be closer than would be possible with the ducts 35 in touching engagement, then the ducts 35 may be vertically offset as is shown in FIG. 7, for example. In FIG. 7, the ducts 35 are sufficiently vertically offset so that the spacing between adjacent ducts, at least in the upper layer of ducts, only has to be slightly greater than the dimension of a heddle 14. It will be seen that by positioning the lower ducts in alignment with gaps between the upper ducts, a very close arrangement of heddles 14 can be obtained.

Figure 8:
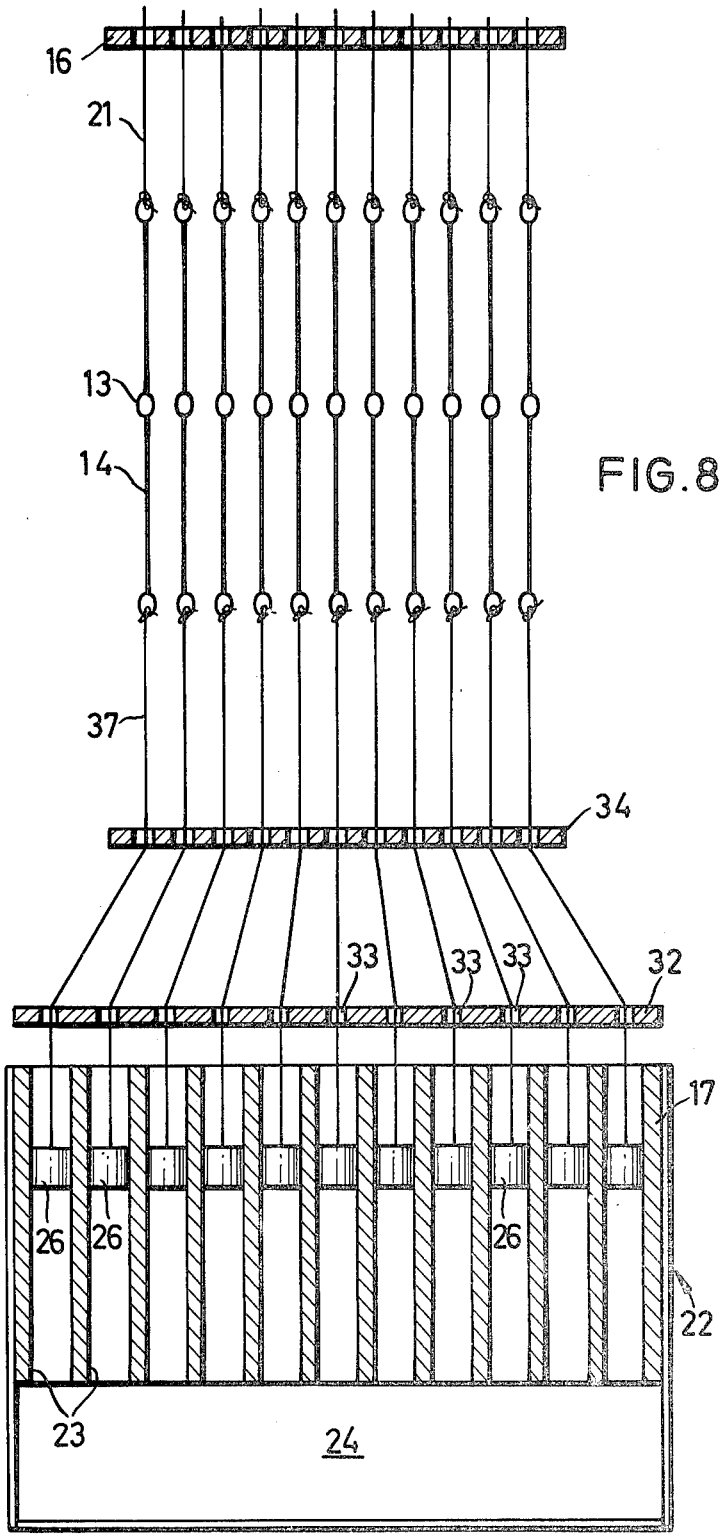
FIG. 8 is an schematic longitudinal section of an alternative embodiment of the invention.

Referring now to FIG. 8 there is illustrated a longitudinal section of another embodiment of the invention. The section of FIG. 8 is taken rectangularly with respect to the end views of FIGS. 2 and 3, but in connection with a modified example. In FIG. 8, the spacing of the cylinder guides 23 is greater than the spacing of the perforations in the harness board 16 so that each hole in the harness board is misaligned to the corresponding cylinder guide. To guide the heddles so that they run at least generally in a vertical direction a first perforated plate 34, the perforations of which correspond to and have the same spacing as the perforations of the harness board 16 is provided. The harness cords 21 passing through the perforations of the harness board are connected with their lower ends to the upper ends of the heddles 14. Cords 37 connecting the lower ends of the heddles 14 with the pistons 26 run through the perforations of the first perforated plate 34 and are deflected to the perforations 33 of a deflection plate 32 which is mounted above the plate 17. The perforations 33 of the deflection plate are adapted to the spacing of the cylinder guides 23 so that the cords 37 diverge from the first perforated plate 34 to the deflection plate 32 and underneath the deflection plate continue substantially in parallel into the respective cylinder guides.

Although only several preferred embodiments of back-pull devices have been specifically illustrated and described herein, it is to be understood that minor variations may be made in the back-pull devices without departing from the spirit and the scope of the invention, as defined by the appended claims.

I claim:

1. A back-pull device for use on heddles of Jacquard looms, said device comprising a piston connected to a first end of each heddle, means at a second opposite end of each heddle for selectively controlling the movement of each heddle between at least two different positions, a cylinder guide receiving each piston in sealed sliding relation, said cylinder guides being carried by a wall of a chamber in which a pressure different from atmospheric pressure is maintained, said cylinder guides opening into said chamber, opposite ends of said piston being subjected to atmospheric pressure and said pressure in said chamber to normally draw said pistons towards said chamber and away from both of said two different positions, and each heddle extends from its respective piston.

2. The pull-back device of claim 1 wherein there is a pattern machine, and a connecting element connects each heddle to said pattern machine in a direction remote from the respective piston.

3. The pull-back device of claim 2 wherein said chamber is maintained at a sub-atmospheric pressure, and said cylinder guides open to the atmosphere towards said pattern machine.

4. The pull-back device of claim 2 wherein said chamber is maintained at a super-atmospheric pressure, and said cylinder guides open to the atmosphere away from said pattern machine.

5. The pull-back device of claim 4 wherein said heddles extend through said chamber.

6. The pull-back device of claim 1 wherein each piston is directly secured to its respective heddle.

7. The pull-back device of claim 2 wherein said pattern machine has associated therewith a perforated harness board positioned between said pattern machine and said cylinder guides, said connecting elements are harness cords extending through said harness board perforations, and the spacing of said cylinder guides correspond to the spacing of said harness board perforations.

8. The pull-back device of claim 1 wherein said chamber is in the form of an elongated duct, there are a plurality of ducts, and there are means individually detachably mounting said ducts on a common support.

9. The pull back device of claim 8 wherein said ducts are arranged at different levels and are laterally offset from each other.

10. The pull-back device of claim 2 wherein said pattern machine has associated therewith a perforated harness board positioned between said pattern machine and said cylinder guides, said connecting elements are harness cords extending through said harness board perforations, and the spacing of said cylinder guides being greater than the spacing of said harness board perforations.

11. The pull-back device of claim 10 wherein said heddles are connected to said pistons by flexible elements and wherein there are means for deflecting at least certain of said flexible elements remote from said chamber.

12. The pull-back device of claim 1 wherein said first and second ends of said heddles are respective lower and upper ends thereof.

* * * * *